United States Patent [19]

Kelter et al.

[11] 4,104,750

[45] Aug. 8, 1978

[54] INFLATABLE INFANT CRIB AND CARRIER

[76] Inventors: S. Louis Kelter; Viviane S. Kelter, both of 1302 W. Sack Dr., Phoenix, Ariz. 85027

[21] Appl. No.: 774,514

[22] Filed: Mar. 4, 1977

[51] Int. Cl.[2] ..... A47C 27/08; A47C 9/00

[52] U.S. Cl. ..... 5/93 R; 5/365; 5/344

[58] Field of Search ..... 5/93, 94 R, 98 R, 349, 5/365, 370, 371

[56] References Cited

U.S. PATENT DOCUMENTS

| | | | |
|---|---|---|---|
| 3,269,621 | 8/1966 | Dishart | 5/94 UX |
| 3,349,413 | 10/1967 | Merelis | 5/94 |
| 3,513,489 | 5/1970 | Miller et al. | 5/98 R |
| 3,619,825 | 11/1971 | Taub et al. | 5/94 |
| 3,761,975 | 10/1973 | Personett | 5/365 |

*Primary Examiner*—Casmir A. Nunberg
*Attorney, Agent, or Firm*—H. Gordon Shields

[57] ABSTRACT

Inflatable infant crib and carrier apparatus is disclosed which includes separate inflatable compartments secured together with straps for appropriately carrying the apparatus.

5 Claims, 5 Drawing Figures

INFLATABLE INFANT CRIB AND CARRIER

BACKGROUND OF THE INVENTION

1. Field of the Invention

This invention relates to portable cribs and carriers for infants, and, more particularly, to inflatable cribs and carriers for infants.

2. Description of the Prior Art

The concept of protecting babies by a cushion of air is not a new concept. Moreover, the idea of using air to support a body, such as with air mattresses, is similarly not a new idea. For example, in U.S. Pat. No. 1,738,411, patented Dec. 3, 1929, a rest and exercising appliance is disclosed which includes a circular hollow tube or outer ring disposed about the periphery of an inner portion comprising a compartmentalized floor. Air pressure is used to support the structure. The inner floor portion if inflatable and it uses ribs for limiting the vertical expansion of the bottom. The ribs provide compartments which are interconnected so that only a single valve is required for inflating the apparatus. The outer ring is also inflatable by a valve separate from the inner portion, and the outer ring is apparently separable from the inner portion.

U.S. Pat. No. 3,018,492, patented Jan. 30, 1962, discloses a protective bumper device which includes a plurality of individual elements, namely four, which are secured together at their ends and which are arranged in a square configuration and placed within a playpen of an infant. The protective bumper device accordingly protects an infant as an infant rolls or crawls within the playpen by preventing the infant's head from bumping against the bars of the playpen. In one embodiment of the U.S. Pat. No. 3,018,492 apparatus, each of the four elements are connected by a one-way valve to allow inflation and deflation from a single location. In a second embodiment, each of the elements is separate and has its own valve for inflation and deflation.

U.S. Pat. No. 3,513,489 discloses a bassinette made out of a plurality of tubular elements which extend about the periphery of a flexible bottom wall to define air inflatable side and end walls which, together with the flexible bottom wall, comprise a bassinette. There is communication between the various elements which comprise the side and end walls so that a single valve element may be used to inflate or deflate the entire bassinette apparatus.

Another type of inflatable apparatus for infants is disclosed in U.S. Pat. No. 3,761,975. The U.S. Pat. No. 3,761,975 apparatus includes a single inflatable chamber which includes a plurality of peripheral air pockets disposed about a central pad area. The peripheral chamber area is configured to encourage an infant to roll towards the center of the central pad area to prevent the infant from rolling against the peripheral wall area.

An inflatable crib is described and claimed in U.S. Pat. No. 3,833,947. The U.S. Pat. No. 3,833,947 apparatus describes a generally rectangular inflatable crib apparatus which is inflatable from a single valve. The base of the apparatus is inflatable, as are the wall portions. The two portions of the crib apparatus, the base and the wall portions, each include separate valves for separate inflation and deflation. However, the wall portion is continuous and is not compartmentalized.

While a single valve is convenient for inflating and deflating an apparatus, there is also an inherent deficiency which offsets the convenience. The deficiency is simply that a single puncture will result in the deflation of the entire apparatus. The inherent disadvantage is not rectified or overcome by using a plurality of tubular elements which are simply separate parts of a single chamber when still inflated and deflated by a single valve.

SUMMARY OF THE INVENTION

The inflatable crib apparatus disclosed and claimed herein comprises a compartmentalized inflatable crib and carrier in which each compartment, although secured to the adjacent compartments, has its own valve for inflating and deflating. Preferably, the air pressure in the wall chambers is about twice the air pressure in the bottom or mattress portion of the apparatus.

Among the objects of the present invention are the following:

To provide new and useful inflatable crib apparatus;

To provide new and useful inflatable crib apparatus comprising a plurality of separate compartments;

To provide new and useful crib apparatus usable as a carrier for an infant;

To provide new and useful crib apparatus for an infant having a plurality of compartments inflatable from a single source;

To provide new and useful inflatable crib apparatus having a plurality of carrying straps for carrying the apparatus either inflated or deflated; and To provide new and useful inflatable crib apparatus having a plurality of compartments secured together but defining a plurality of separate air chambers.

DESCRIPTION OF THE PREFERRED EMBODIMENT

Figure 1:
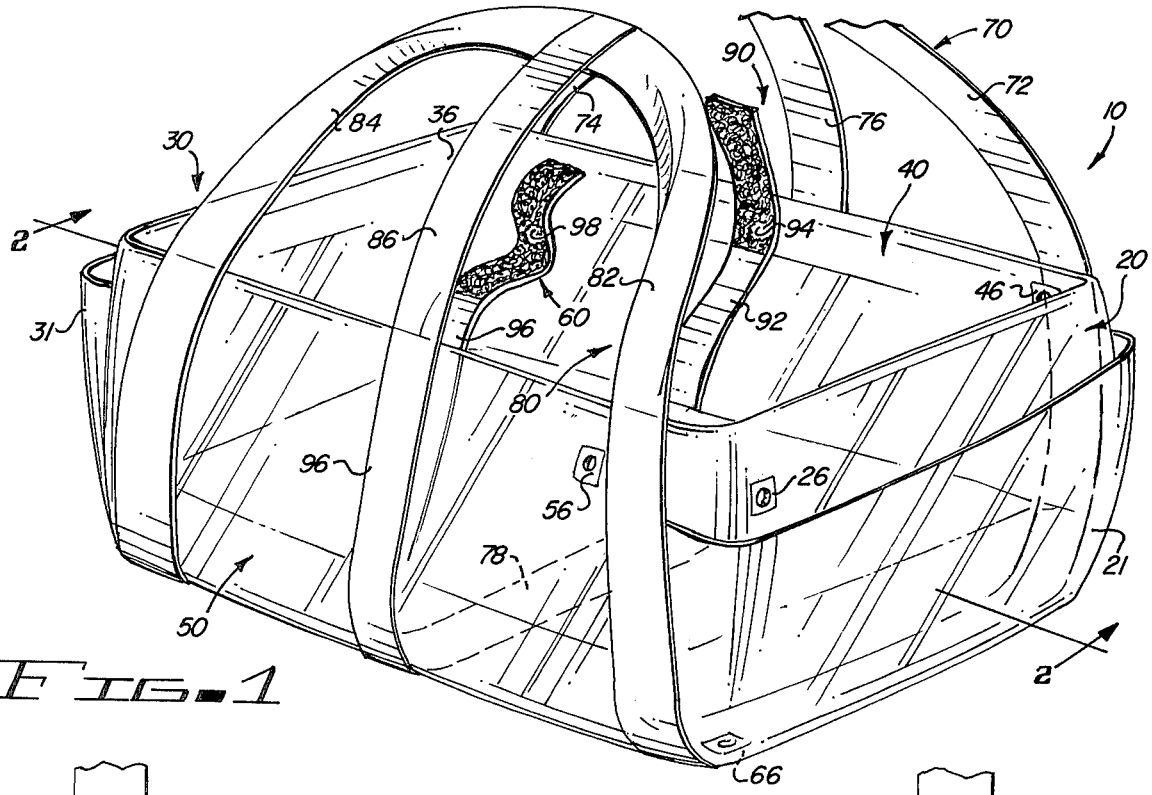
FIG. 1 is a perspective view of crib apparatus of the present invention.

FIG. 1 is a perspective view of an inflatable crib 10 comprising a plurality of separate compartments. There are five separate compartments, each of which is inflatable and each of which is a pneumatic chamber, connected to the adjacent chambers, but sealed from the adjacent chambers. The chambers may be inflated from a single source, as discussed below, but they are sealed units or cells, independent of the adjacent and other cells. The apparatus 10 includes two end chambers or cells 20 and 30 and two side chambers 40 and 50, which together define four inflatable walls. A fifth chamber or cell 60 comprises the bottom or mattress portion of the crib apparatus 10.

The end walls, side walls, and bottom or mattress portion each comprise separate cells or chambers which define separate pneumatic compartments. When inflated, the side walls and end walls balloon outwardly and inwardly from a center as they extend upwardly to provide a cushion for an infant disposed within the apparatus and also to provide overall support for the apparatus. The end chambers 20 and 30 are directly secured to the side chambers 40 and 50 and, when inflated, the four chambers comprise vertically extending walls which are gently rounded outwardly from the center of each cell or compartment to provide a cushion for the infant disposed within the apparatus from both inward or outward forces. The infant within the apparatus is free to move within the apparatus and, by the pneumatic cushioning of the walls, the infant is prevented from hurting itself as it moves, and, at the same time it is protected from external harm or blows by the same pneumatic cushioning effect of the four walls.

The apparatus may, if desired, be fabricated from a single sheet of plastic material, such as polyvinylchloride film, preferably of a thickness of twenty to 24 mils. The chambers may be sealed from adjacent chambers by well-known processes, such as thermal welding.

The walls of each chamber or compartment are accordingly two layers of relatively thick plastic material which define between the two walls a single chamber or compartment. The bottom portion 60, which comprises a mattress, is constructed of the same material as are the side and end walls, and as indicated, may be part of an integrated whole fabricated as part of the overall apparatus 10. The bottom portion or mattress 60 expands only a predetermined amount, which is unlike the four peripheral walls. The walls, which extend generally vertically upwardly from the outer periphery of the mattress portion 60, expand according to the air pressure within them, limited, of course, by the elasticity of the material out of which they are made and by their particular design. However, the mattress portion 60, while comprising only a single chamber, uses a plurality of short straps to limit the vertical distance between the two layers which comprise the bottom compartment. This results in a generally flat mattress on which an infant may be disposed.

At opposite ends of the crib apparatus 10 are flaps 21 and 31, which are secured to the end chambers 20 and 30, respectively, on three sides of the flaps, namely the bottom of the flaps and the two ends of the flaps. The flaps are not sealed to the end chambers on the top and accordingly define, between the end flaps and the outer walls of the end chambers, a pair of pouches or pockets into which may be inserted baby bottles, diapers, or the like.

Appropriate carrying straps 70 and 80 are secured to the sides and the bottom of the apparatus and define carrying straps for carrying the crib apparatus in both its inflated and its deflated conditions. The carrying strap 70 includes two end portions 72 and 74 and a center portion 76. The end portions 72 and 74 are secured to the side chamber 40 adjacent the juncture of the side chamber 40 with the end chambers 20 and 30, respectively. The end portions 72 and 74 are secured to the chambers, by appropriate means, such as by thermal welding, as discussed above.

The center portion 76 is joined to the strap 70 in an appropriate manner, such as by thermal welding, at about the midpoint of the strap 70, which is the juncture or dividing line between the two end portions 72 and 74. The center portion 76 is secured to the crib apparatus 10 adjacent the juncture of the bottom chamber 60 and the side chamber 40. The strap 70 also includes a bottom portion 78 which extends beneath the bottom chamber 60 of the crib apparatus and may be secured thereto, as appropriate. The bottom portion 78 extends upwardly adjacent the side chamber 50 where it becomes center portion 86 for carrying strap 80. The carrying strap 80 is substantially identical to the carrying strap 70. The carrying strap 80 includes two end portions 82 and 84 which are substantially mirror images of the respective end portions 72 and 74 of the carrying strap 70. The end portions 82 and 84 are appropriately secured to the crib apparatus 10 adjacent the juncture of the bottom 60 with the side chamber 50 at, respectively, the end walls 20 and 30. The center portion 86 extends upwardly from the juncture of the side wall 50 and the bottom 60 to the midpoint of the carrying strap 80 to which it is secured. The center portion 86, at the midpoint of the carrying strap 80, divides the strap 80 into its two end portions 82 and 84, substantially identical to the carrying strap 70 and its respective elements or portions.

Within the crib apparatus, and disposed at about the midpoint of the side chambers, is a harness or belt 90. The harness or belt 90 includes two strap portions, a strap 92 and a strap 96, both of which are sealingly secured to the juncture of the bottom portion 60 with the respective side chambers 40 or 50. The straps 92 and 96 each include a fastener portion to appropriately secure an infant disposed in the crib apparatus. The strap 92 includes a fastener portion 94 at its outer or distal end, remote from the juncture of the side wall 40 and bottom 60 where the strap 92 is secured to the apparatus. Similarly, the strap 96 includes a fastener portion 98 on its outer or distal end, remote from where the strap 96 is secured to the apparatus. Typically, the fastener materials 94 and 98 may be "Velcro" with cooperating portions of the Velcro secured respectively to the bottom or underneath side of the strap 92 and to the top or upper side of the strap 96. With the "Velcro" material secured to the respective straps over a relatively long length of the straps, the straps may be used to secure infants of various sizes securely into the crib apparatus. A substantial overlap in the Velcro material insures that the infant is securely harnessed in the apparatus.

Each separate compartment or chamber includes its own valve for inflation and deflation. In FIG. 1, two valves 26 and 56 for the end chamber 20 and side chamber 50, respectively, are shown. Other valves 36, 46, and 66 are also shown. In the environment of FIG. 1, the inflatable crib apparatus 10 appears to be made of clear material, and accordingly the valves 36, 46, and 56 are shown, but not in the same detail as are the valves 26 and 56 because they are on the side of the apparatus away from the viewer of the FIGURE. In other words, they are seen through the apparatus. The valve structure will be disclosed and discussed in detail below, in conjunction with FIGS. 3 and 4.

Figure 2:
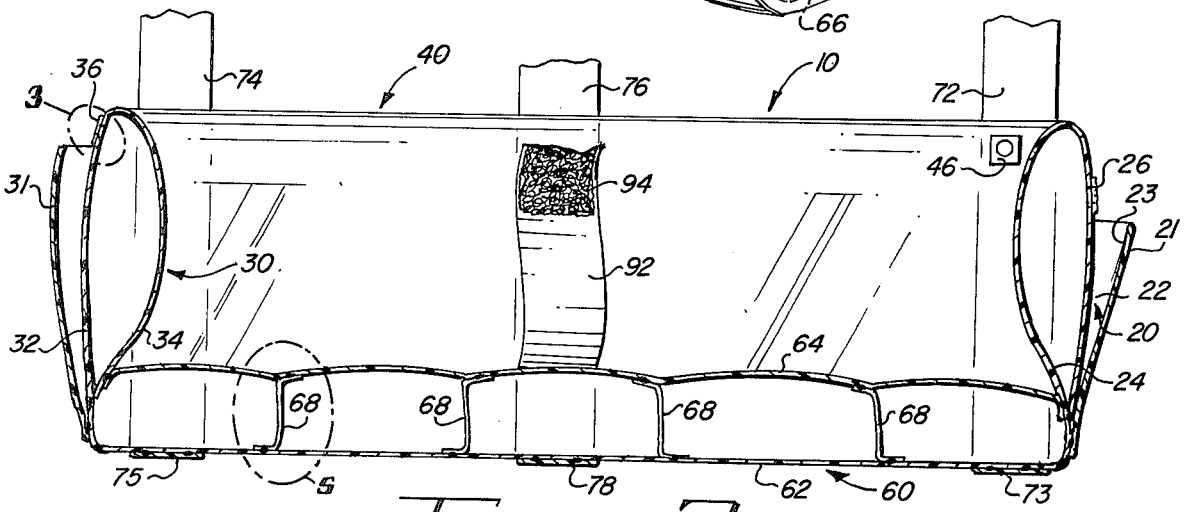
FIG. 2 is a view in partial section of the crib apparatus of FIG. 1 taken generally along line 2—2 of FIG. 1.

FIG. 2 is a view in partial section of the apparatus of FIG. 1 taken generally along line 2—2 of FIG. 1. It comprises a view through the end chambers 20 and 30 and the bottom chamber 60, looking toward the side chamber 40.

The end chamber 20, which comprises an inflatable cell, includes an outer wall 22 and an inner wall 24. The outer and inner walls of each chamber are spaced apart to provide a cushioning effect to cushion an infant disposed within the crib apparatus. The chamber 20 is inflated and deflated by means of the valve 26. The end flap 21 is shown extended outwardly from the outer wall 22 of the end chamber 20 and a pocket or pouch 23 is defined between the end flap 21 and the outer wall 22. The pouch or pocket is simply a carrying compartment for diapers, bottles, or the like.

The vertical cross sectional configuration of the chambers 20 and 30, as shown in FIG. 2, and also the vertical cross sectional configuration of the side chambers 40 and 50 (see FIG. 1), is generally oval. This provides a relatively constant vertical convex curvature for the four wall chambers. The vertical convex configuration provides maximum protection to an infant disposed within the crib apparatus in two ways. First, any inwardly directed blow or shock is substantially absorbed by the cushioning effect of an air chamber and is not transmitted through the chamber. Any such blow may cause a convex indentation in the outer wall of a chamber, but such indentation results only in an increase in pressure within the chamber or in an increase in the convex configuration of the inner wall of the chamber with respect to the area within the four walls of the crib apparatus.

Second, the vertical convex configuration does not lend itself to encouraging or helping an infant to crawl up and over the wall. Moreover the convex wall configuration does not provide a pillow surface against which an infant may be propped. Rather, such configuration encourages an infant to remain within the apparatus and substantially completely on the mattress chamber or portion within the area bounded by the four wall chambers.

The end chamber 30 is substantially identical to the end chamber 20. The chamber 30 includes a pair of walls, an outer wall 32 and an inner wall 34, spaced apart from each other, and inflation and deflation of the chamber 30 between the outer and inner walls is accomplished by means of the valve 36. End flap 31 is sealingly secured to the outer wall 32 at the bottom portion of the end chamber 30, adjacent the lower portion of the bottom chamber 60. The end flap 31 is also secured at its opposite ends, as discussed above, adjacent the side chambers 50 and 60. A pouch or pocket is defined between the end flap 31 and the outer wall 32, such as shown in conjunction with end chamber 20.

The side chamber 40 is substantially identical in construction to the end chambers 20 and 30. The side chamber 40 is inflated and deflated through a valve 46.

Extending upwardly from the outer portion of the side chamber 40 are straps 72, 74, and 76. The straps 72 and 74 comprise the end portions of the carrying strap 70, illustrated in FIG. 1. The strap 76 is the center portion of the carrying strap and it is secured to the end straps 74 and 72 at about the center portion of the carrying strap 70, as shown in FIG. 1. The straps 72, 76, and 74 are secured to the inflatable crib apparatus, as by thermal welding, previously discussed. The straps extend in a continuous fashion beneath the bottom chamber 60, as discussed above, and as shown in FIG. 2. The bottom portion of the strap 22 which extends beneath the bottom chamber 60, adjacent the end chamber 20, is denoted by reference numeral 73, and the bottom portion of the end strap 74 is denoted by reference numeral 75. The bottom portion of the center strap 76 is denoted by reference numeral 78. In FIG. 2, thermal welds are shown securing the bottom portion 73, 75, and 78 of the straps 72, 74, and 76, respectively, to the bottom chamber 60.

The bottom chamber 60 includes an outer wall 62 and an inner wall 64. The outer and inner walls are spaced apart by pneumatic pressure and the limitation of their spacing is defined by a plurality of spacers 66. The spacers are relatively short lengths of material, preferably of the same material out of which the apparatus is made, which lengths are secured to both the inside of the outer wall and the inner wall. The spacers limit the distance which the outer and the inner walls may be spaced apart under the pneumatic pressure within the chamber. The spacers are shown in more detail in FIG. 5 and are discussed in conjunction therewith.

The spacers are not ribs which define compartments or pockets within the main chamber, as is the case with most of the prior art. Rather, the spacers are relatively narrow strips of material spaced apart from each other in a regular pattern so as to provide as flat a top surface as is possible, under the circumstances, for the bottom chamber 60, which comprises the mattress for the infant disposed within the apparatus on the bottom chamber. If desired, adjacent rows of the spacers could be staggered instead of having the adjacent rows uniformly and regularly spaced.

Within the inflatable crib apparatus 10 is shown the strap 92 of the harness or belt 90 (see FIG. 1). The fastener 94 is shown disposed on the bottom side of the strap 92. The fastener of fastening material 94 is preferably a portion of the "Velcro" fastener, which requires cooperating fastening portions, one sewn on each of the two portions of the elements which are to be secured together. The strap 92 is preferably secured to the inside of the apparatus at the juncture of the side chamber 40 with the bottom chamber 60.

As indicated above, the four wall chambers, comprising the end wall chambers 20 and 30 and the side wall chambers 40 and 50, are inflated to about twice the pressure of the bottom chamber 60. Typically, it is preferred that the wall chambers be inflated to a pressure of about ten pounds per square inch, while the bottom chamber 60 is inflated to a pressure of about five pounds per square inch.

The inflation of the side chambers provides a substantially rigid rectangular frame for the inflatable crib apparatus. The rigidity provided by the inflation is sufficient to maintain the general orientation of the apparatus even if one of the chambers were to deflate accidentally, as from a puncture. The adjacent wall chambers, and the bottom chamber, provide sufficient structural strength to permit the apparatus to continue in use until the deflated chamber can be reinflated after repair.

As may be seen in FIG. 2 with respect to the end chambers 20 and 30, there is a generally oval configuration to the wall chambers when inflated. The overall rectangular configuration of the apparatus somewhat limits or controls the outward expansion of the four side walls as they inflate, and tends to promote the rounded, or semi-rounded oval cross-sectional configuration of each inflated wall chamber. The configuration is, as may be expected, greatest toward the middle, vertically, of each chamber, and is minimal at the lower portion of the apparatus, where the respective wall chambers are secured to, or join, the bottom chamber 60. With this general configuration, an infant disposed within the apparatus is protected from accidental smothering and at the same time is cushioned from any outward shock or by its own movement. The vertically upwardly and inwardly extending configuration of the inner wall of each chamber from the juncture of each wall chamber with the bottom chamber 60 prevents an infant from accidentally or otherwise moving outwardly and, in the event of some type of external impact, tends to bias the infant downwardly and inwardly within the protected portion of the crib apparatus. The continuous curve of the wall chambers prevents an infant from being smothered by direct contact because direct contact over an area as large as an infant's face, and/or torso is substantially impossible. The same thing is true with respect to the top or upper side of the inner wall 64 of the bottom chamber 60. The top or upper surface has a dimpled configuration due to the spacer straps 68. However, as indicated above, the overall configuration of the inner wall 64 is relatively flat and provides a suitable mattress top for an infant.

Figure 3:
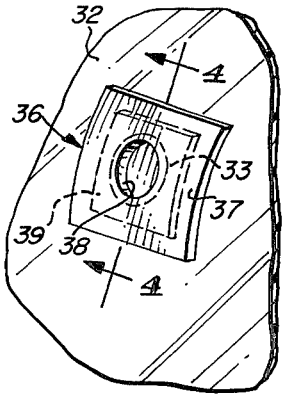
FIG. 3 is an enlarged view of a portion of the apparatus of FIG. 2 taken generally along circle 3 of FIG. 2.

FIG. 3 is an enlarged view of a portion of the apparatus of FIG. 2 taken generally along circle 3 of FIG. 2. It comprises an enlarged view of the outer wall 32 of the end chamber 30 (see FIG. 2) illustrating the valve 36 through which the end chamber 30 is inflated and deflated.

The valve 36 comprises a plate 37 sealingly secured to the outer wall 32 over an aperture 33 which extends through the outer wall 32. The plate 37 is preferably made of the same material as the rest of the crib apparatus, such as 20–24 mil pvc, as discussed above. An aperture 38 extends through the plate 37. A flap 39 is secured about the aperture 38 and the aperture 33 on the inside of the outer wall 32. The flap 39 is movable and is accordingly secured on only one of its sides to allow it to pivotally move away from the inner side of the wall 32.

Figure 4:
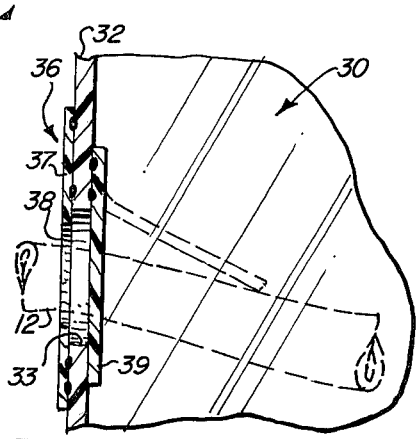
FIG. 4 is an enlarged view in partial section of the apparatus of FIG. 3 taken generally along line 4—4 of FIG. 3.

FIG. 4 is a view in partial section of the valve apparatus 36 of FIG. 3 taken generally along line 4—4 of FIG. 3. The outer wall 32 is shown with the aperture 33 extending through the wall 32. The plate 37 is shown secured to the outer side of the wall 32 adjacent the aperture 33. The aperture 38 extends through the plate 37 substantially concentrically with respect to the aperture 33, but the aperture 38 is of a lesser diameter than is the aperture 33. A tube 12 is shown in phantom inserted through the valve 36 and biasing the flap 39 away from the aperture 33.

The flap 39 is disposed against the inner side of the wall 32, and is secured to the inner side above the aperture 33. The flap 39 covers the aperture 33 and accordingly sealingly secures the end chamber 30, with its higher air pressure, from the outside ambient air, with its lower air pressure. The flap 39 pivots away from the aperture 33 to the position shown in phantom in FIG. 4 in response to the urgings of the tube 12 which is inserted through the coaxial apertures 33 and 38. If it is desired to inflate the chamber 30, then air pressure is pumped into the chamber 30 through the tube 12. When the tube 12 is removed, the flap 39 moves against the aperture 33 in the wall 32 and is held against the wall in a sealing engagement by the differential air pressure inside and outside the chamber 30. Preferably, the exterior diameter of the tubing 12 is substantially the same as the diameter of the aperture 38.

If it is desired to deflate the chamber 30, the tubing 12 is inserted into the chamber and the pressure within the chamber is allowed to vent to outside ambient air pressure through the tube 12.

As illustrated herein, the valve 36 comprises a very simple one-way valve, using the flap 39 to prevent the flow of pressure from within the chamber 30 outwardly through the apertures 33 and 38. Obviously, other valve apparatus or a different arrangement could be used. For example, a pair of valves could be used, with each inlet valve including a length of tubing, such as tubing 12, sealingly secured to the outer walls of the chamber and a one-way valve, such as the flap 39, disposed over the end of the tubing within the chamber. Externally of the chamber, the tubing from each chamber could be secured together to a common point such that inflation could be accomplished from a single source. When inflated to the desired pressure, the source of pressure, pump, or whatever, could be disconnected from the tubing and each chamber would be sealed by the one-way flapper valve secured to the tubing within the chamber. A second valve, such as the valve 36, could also be located in each chamber, perhaps adjacent to the inflation valve, for appropriate deflation with a short piece of tubing, or the like.

More sophisticated valves could also be used, and such are well-known in the pneumatic art. However, the valve arrangement disclosed and discussed herein is a relatively inexpensive, simple, and yet effective valve system for controlling the inflation and deflation of the mattress apparatus 10.

Figure 5:
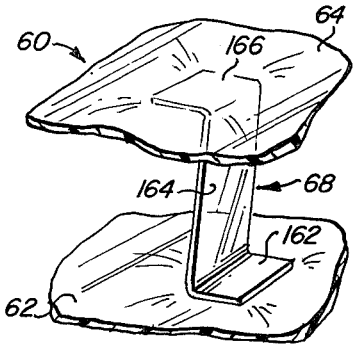
FIG. 5 is an enlarged perspective view of a portion of the apparatus of FIG. 2 taken generally from circle 5 of FIG. 2, and partially broken away from the apparatus of FIG. 2.

FIG. 5 is an enlarged perspective view of a portion of the apparatus of FIG. 2 taken generally from circle 5 of FIG. 2. It comprises an enlarged, partially broken away view of a single spacer 68 secured to and between the outer wall 62 and the inner wall 64 of the bottom chamber 60.

The spacer 68 comprises an intermediate portion 164 disposed between a pair of end pieces 162 and 166. The end pieces 162 and 166 are generally shorter than the center or intermediate portion 164 and are appropriately sealed to the inner sides of the outer and inner walls 62 and 64, respectively. The spacer 68 is preferably made of the same material as the rest of the crib apparatus, and is accordingly flexible, but relatively inelastic. While the material may have some elastic properties, the elasticity of the material is such that the spacer 68 will not overly elongate when pressure increases within the lower chamber 60 to inflate the mattress or bottom chamber.

It will be noted that the outer and inner walls 62 and 64 appear to be dimpled adjacent the end portions 162 and 166. Assuming that the pressure within the chamber 60 is greater than the ambient pressure outside of the chamber 60, the inner and outer walls 62 and 64, under the influence of the positive pressure within the chamber 60, extend outwardly or away from the spacer 68 and a dimpling effect results. If the spacers 68 are disposed in a regular arrangement, but staggered with respect to adjacent rows, the overall effect will be a generally flat inner wall 64 as shown in FIG. 2, which provides a suitable mattress on which an infant may be disposed within the crib apparatus 10, but yet provides a surface which is sufficiently irregular to prevent an infant from being smothered by getting its face flat against it.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Inflatable crib apparatus, comprising, in combination:

inflatable wall chamber means, including first and second inflatable end chambers spaced apart from each other and disposed substantially parallel to each other, first and second inflatable side chambers spaced apart from each other and disposed substantially parallel to each other and secured to the first and second end chambers to define a generally rectangular peripheral wall, and the first and second end chambers and the first and second side chambers each having a generally oval vertical cross sectional configuration providing a vertical convex wall configuration to the area within the end and side chambers;

inflatable mattress means comprising a mattress chamber secured to and disposed within the end and side chambers of the wall chamber means at a lower portion thereof and including an inner wall and an outer wall spaced apart from each other and a plurality of flexible spacers secured to both outer and inner walls for limiting the distance between the inner and outer walls to provide a generally flat surface upon which an infant is disposed;

valve means comprising at least a single valve for each of the first and second end chambers, the first and second side chambers and the mattress chamber for inflating and deflating each of said chambers and to prevent the deflation of any one chamber from resulting in the deflation of any other chamber; and strap means secured to the wall chamber means and to the mattress means for carrying the crib apparatus.

2. The apparatus of claim 1 in which the end chambers and the side chambers of the wall means each include convexly curved inner and outer walls.

3. The apparatus of claim 2 in which the chambers of the wall chamber means are inflated to a pressure about twice the pressure of the mattress chamber.

4. The apparatus of claim 2 in which the strap means includes means for securing the infant on the mattress means.

5. The apparatus of claim 2 in which the wall chamber means includes a pocket secured to an outer wall.

* * * * *